United States Patent [19]

Deutschmann et al.

[11] 4,248,198

[45] Feb. 3, 1981

[54] MULTI-CYLINDER DIESEL ENGINE

[75] Inventors: Herbert Deutschmann, Friedrichshafen; Franz Geray, Langenargen, both of Fed. Rep. of Germany

[73] Assignee: Motoren und Turbinen-Union Freidrichshafen GmbH, Fed. Rep. of Germany

[21] Appl. No.: 964,173

[22] Filed: Nov. 28, 1978

[30] Foreign Application Priority Data

Dec. 1, 1977 [DE] Fed. Rep. of Germany ..... 2753584

[51] Int. Cl.[3] ..... F02B 33/02

[52] U.S. Cl. ..... 123/559; 123/198 F

[58] Field of Search ..... 60/628, 605; 23/119 C, 23/198 F; 417/237

[56] References Cited

U.S. PATENT DOCUMENTS

| | | | |
|---|---|---|---|
| 970,153 | 9/1910 | Winand | 123/119 C |
| 2,103,564 | 12/1937 | Tanner | 123/198 F |
| 3,958,900 | 5/1976 | Ueno | 123/198 F X |
| 4,191,152 | 3/1980 | Deutschmann | 123/119 C |

FOREIGN PATENT DOCUMENTS

| | | | |
|---|---|---|---|
| 2719668 | 11/1978 | Fed. Rep. of Germany | 60/605 |

*Primary Examiner*—Michael Koczo
*Attorney, Agent, or Firm*—Craig and Antonelli

[57] ABSTRACT

A multi-cylinder supercharged diesel engine with low compression ratio, in which for starting and possibly at partial load operation a number of the cylinders are operated as a compressor and the compressed air produced by the same is fed to the remaining cylinders operating as an engine in addition to the combustion air sucked-in by the latter to achieve sufficient ignition conditions. One or several intermediate storage devices for the compressed air are provided which are connected with the cylinders operating as the compessor by way of valves adapted to be closed and with the cylinders operating as the engine by way of valves controlled in dependence on the piston position during the suction stroke and/or compression stroke of the corresponding cylinder operating as the engine.

20 Claims, 5 Drawing Figures

MULTI-CYLINDER DIESEL ENGINE

The present invention relates to a multi-cylinder diesel engine, and more particularly to a multi-cylinder supercharged diesel engine with low compression ratio.

The power output increase of diesel engines is customarily realized by the combustion of larger fuel quantities. The correspondingly high combustion air requirement is thereby covered by the supply of pre-compressed air to the cylinders. It has been generally accepted as advantageous to undertake the compression or supercharging of the combustion air by means of turbochargers driven by the exhaust gases of the engine.

With diesel engines having normal compression ratios of greater than 1:12, the magnitude of the pre-compression of the combustion air and therewith the attainable output increase is limited by the harmful ignition pressure peaks in the cylinders which increase therewith. A known measure to utilize high pre-compression degrees of the combustion air without increasing the peak pressures, consists in reducing the compression ratio of the engine cylinders.

However, the disadvantage arises in connection therewith that the engines (without special auxiliary means) can no longer be started and operated at partial load because under these operating conditions no exhaust gas quantities or excessively small exhaust gas quantities are available for the drive of the turbocharger and thus the compression-end-pressure and temperature are no longer sufficient for the ignition of the injected fuel due to a lack of pre-compression of the combustion air.

In order nonetheless to be able to start such engines, it has become known, apart from very expensive methods, to cause a number of the cylinders to operate as compressors during the starting operation and to supply under pressure the air compressed by the cylinders operating as on compressors to the remaining cylinders operating as engine.

In one proposed engine construction, the valve control is constructed for that purpose to be shiftable in such a manner that the cylinders operating as a compressor suck in the air out of the exhaust gas line and feed the same into the suction line closed thereby by a closure device, from where the air enters under pressure into the cylinders operating as engine during the suction stroke thereof. The very complex and costly shiftable valve control is disadvantageous with this construction, which, for the most part, can no longer be accommodated in existing engine designs and constructions and thus requires a new construction and design of the entire engine. Additionally, the unfiltered air sucked-in out of the exhaust gas line is soiled with soot and cinder particles which may lead to considerable engine damages in a short period of time. Consequently, this engine construction is totally unsuited for an operation at partial load.

In another known non-supercharged engine construction, the exhaust gas lines of the cylinders operating as a compressor are also closed off by closure devices for starting purposes. The air supplied from these cylinders during the exhaust stroke by way of the exhaust valves into the exhaust gas lines is conducted by way of a common line or manifold starting from the exhaust gas lines into the suction line of the cylinder operating as an engine, which is thereby also closed off from the suction lines of the cylinders operating as the compressor by a closure device. The considerable disadvantage of this construction resides in the fact that the closure devices in the exhaust gas lines exposed during engine operation to the hot and corrosive exhaust gases, become non-usable after a short period of time. Additionally, the cylinders operating as the engine receive no suction air of their own due to the closing of their suction line but only the air quantity of the cylinders operating as the compressor, so that for purposes of achieving a utilizable pre-compression the majority of the existing cylinders have to operate as the compressor, whence a reasonable partial load operation of the engine also cannot be realized.

Finally, with a proposed construction which, however, has not yet been publicly disclosed, the compressed air of a cylinder operating as the compressor is fed in each case to a coordinated cylinder operating as the engine by way of one connecting line each and suitable valves. However, it is a prerequisite for this construction, which requires only a small structural expenditure, that the compression stroke of each cylinder operating as the compressor terminates shortly prior to the compression stroke of the coordinated cylinder operating as the engine in order that the compressed air of the compressor cylinder is reliably forced into the associated engine cylinder approximately at the beginning of a compression stroke with closed inlet and exhaust valves in addition to the air sucked-in by the engine cylinder prior thereto.

This prerequisite, however, exists only with few given engine constructions having suitable cylinder numbers so that this measure is applicable only to a very limited extent. Additionally, this prerequisite often cannot be realized with new constructions in the interest of a good vibration and oscillation behavior of the engine.

The present invention relates to a multi-cylinder supercharged diesel engine with low compression ratio, in which for purposes of starting and possibly during the partial load operation a part of the cylinders are operated as a compressor and in which the compressed air produced by the same, is supplied to the remaining cylinders operating as an engine—in addition to the combustion air sucked-in by the latter, for purposes of achieving a sufficient ignition condition.

The aim of the present invention essentially consists in assuring the starting and the partial load operation of diesel engines with low compression ratios of any type of construction and any number of cylinders by simple and operationally reliable means while avoiding the described disadvantages of the prior art constructions.

The underlying problems are solved according to the present invention by one or several intermediate storage devices for the compressed air, which are connected with the cylinders operating as a compressor by way of valves adapted to be closed and with cylinders operating as an engine by way of valves controlled in dependence on the piston position during the suction and/or compression stroke of the corresponding cylinder operating as the engine.

In a preferred embodiment of the present invention, one intermediate storage device each is coordinated to a respective cylinder operating as the compressor and to a respective cylinder operating as the engine, which is formed advantageously by the compressed air line having a corresponding cross section which connects the two cylinders, and thus only slight structural expenditures are required for the intermediate storage device.

For purposes of avoiding a return flow of compressed air, valves adapted to be closed which are arranged between the cylinders operating as the compressor and the intermediate storage devices are constructed according to the present invention as check valves with the through-flow direction from the compressor cylinder toward the intermediate storage device.

For purposes of avoiding a braking action during the downward movement of the piston of the cylinders operating as the compressor with closed inlet and exhaust valves, each valve adapted to be closed includes a further check valve for the connection of the compressor cylinder with the atmospheric air or with the suction line of the diesel engine, whereby the through-flow direction of such further check valve is from the atmospheric air, respectively, from the suction line to the compressor cylinder.

For an operationally reliable transition from starting, respectively, partial load operation, to the operation at higher loads of the diesel engine a control mechanism which acts on the injection pump and on the valves adapted to be closed is arranged in such a manner that during the starting and possibly during the partial load operation of the diesel engine, the injection pump correspondingly supplies with fuel only the cylinders operating as the engine and the valves adapted to be closed are thereby in the opened position while at higher loads of the diesel engine, the injection pump correspondingly supplies with fuel all cylinders and the valves adapted to be closed are thereby in the closing position.

For purposes of reliably avoiding the overflow of air from the cylinders operating as the engine into the intermediate storage devices, above all when all cylinders of the diesel engine operate as engine cylinders and the intermediate storage devices are not supplied with compressed air, the valves between the intermediate storage devices and the cylinders operating as the engine, which are controlled in dependence on the piston position of the associated cylinder operating as the engine, are constructed as check valves with a through-flow direction from the intermediate storage device to the associated cylinder.

In case the constructive conditions of the diesel engines so permit, the control valves are preferably constructed as mechanical valves actuated by the cam shaft.

If, however, valves mechanically actuated by the cam shaft are constructively difficult or can be accommodated only with great structural expenditure, the control valves may be actuated by a pressure medium or by electromagnets by means of a control distributor driven by the crankshaft or the cam shaft.

Accordingly, it is an object of the present invention to provide a multi-cylinder diesel engine with low compression ratio, which avoids by simple means the aforementioned shortcomings and drawbacks encountered in the prior art.

Another object of the present invention resides in a multi-cylinder diesel engine with low compression ratio, which can be reliably started and operated in the partial load range without producing harmful ignition pressure peaks.

A further object of the present invention resides in a multi-cylinder diesel engine operating at low compression ratios, which assures a sufficient compression end pressure and temperature for the ignition of the injected fuel notwithstanding the relatively low compression ratio of the engine.

A still further object of the present invention resides in a diesel engine of the type described above which is able to achieve all of the aforementioned aims and objects, yet obviates the need for costly, complicated valve controls.

Another object of the present invention resides in a multi-cylinder diesel engine operating at relatively low compression ratios, which can be readily started and operated at partial load, yet permits the use of hitherto customary engine designs without danger of damage to any of the engine parts.

Still another object of the present invention resides in a diesel engine operating at a low compression ratio, which can be readily started and operated at partial loads, yet does not require a complete redesign of the various parts of the engine.

A further object of the present invention resides in a diesel engine of the type described above which notwithstanding the low compression ratio assures a reliable starting and partial load operation by simple and operationally reliable means applicable to any type of construction and any number of cylinders used in a given engine.

These and other objects, features and advantages of the present invention will become more apparent from the following description when taken in connection with the accompanying drawing which shows, for purposes of illustration only, two embodiments in accordance with the present invention, and wherein.

Figure 1:
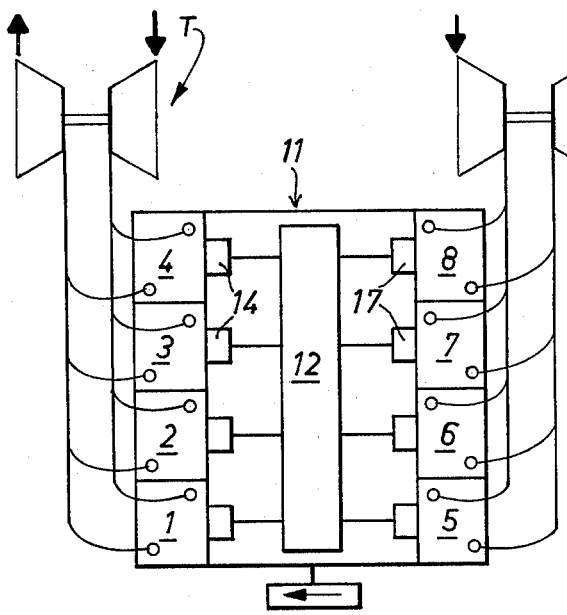
FIGS. 1 and 2 are schematic plan views on two embodiments of a diesel engine with eight cylinders in V-arrangement according to the present invention.

Referring now to the drawing wherein like reference numerals are used throughout the various views to designate like parts, reference numeral 11 generally designates a diesel engine with relatively low compression ratio with the engine 11 being supercharged by, for example, exhaust gas turbochargers generally designated by the reference character T. In the diesel engine 11, the cylinders 1 to 4 are operated as a compressor during the starting and possibly during partial load operation in order to supply the compressed air produced by these cylinders 1 to 4 to the cylinders 5 to 8 operating as an engine, in addition to the combustion air sucked-in by the latter.

Since the compressed air has to be fed to the engine cylinders 5 to 8 during a certain part of the operating cycle, at the earliest toward the end of the suction stroke and during the compression stroke, an intermediate storage device 12 for the entire compressed air produced by the cylinders 1 to 4 operating as the compressor is provided in the embodiment according to FIG. 1 between the cylinders 1 to 4 operating as the compressor and the cylinders 5 to 8 operating as the engine. In lieu of a single intermediate storage device, several intermediate storage devices may also be provided which may then be coordinated each to a desired number of cylinders.

Figure 2:
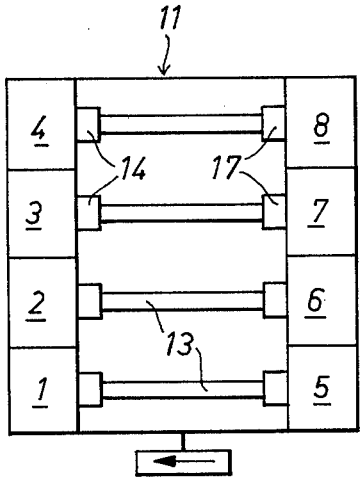

In a preferred embodiment of the present invention according to FIG. 2, one intermediate storage device 13 each is provided for each of the cylinders 1 to 4 operating as the compressor and for each of the coordinated cylinders 5 to 8 operating as engine. Each intermediate storage device 13 is thereby advantageously formed by the compressed air line for the connection of the mutually coordinated cylinders and is constructed for that purpose with a corresponding cross section.

Figure 3B:
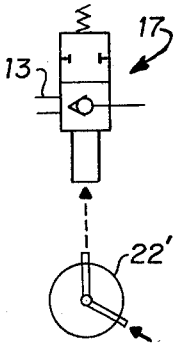
FIGS. 3A and 3B are schematic views of an electromagnetic and pressure medium actuated control devices for control valves in accordance with the present invention.
Figure 3A:
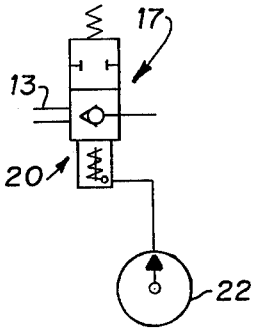
Figure 3:
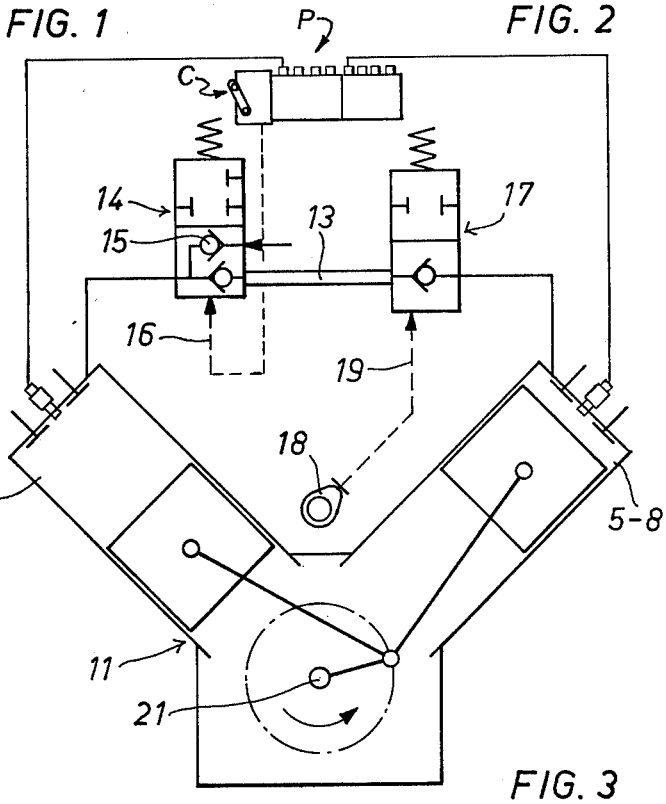
FIG. 3 is a schematic cross-sectional view through a diesel engine illustrating certain details in accordance with the present invention.

Valves generally designated by reference numeral 14 which are operable to be closed are arranged between the cylinders 1 to 4 operating as compressor and the intermediate storage devices 12 or 13, which are in the operating position thereof illustrated in FIG. 3 for the starting and in the partial load operation, in which they permit to the compressed air produced during the upward movement of the piston in the corresponding cylinder 1 to 4 to flow into the intermediate storage device 12 or 13. These valves 14 are constructed as check valves with the through-flow direction from the compressor cylinder 1 to 4 to the intermediate storage device 12 or 13 in order to prevent the return flow of the compressed air out of the intermediate storage devices 12 or 13 into the cylinders 1 to 4 during the downward movement of the pistons.

For purposes of avoiding unnecessary losses due to a braking action during the downward movement of the pistons of the cylinders 1 to 4 operating as compressors, which downward movement follows the compression stroke thereof, while the inlet and exhaust valves are closed, one check valve 15 each may be provided for the connection of these cylinders 1 to 4 with the atmospheric air or with the suction line, which is preferably built into the respective valve 14.

The valves 14 which during normal engine operation, when all cylinders operate as the engine, are in the normal position with closed through-flow, are actuated for the purpose of starting and for the partial load operation into the illustrated operating position with the described through-flow directions by a suitable mechanical, electro-magnetic or pressure—medium—actuated mechanism 16 of any known type.

Preferably, as shown in FIG. 3, the actuating mechanism 16 is controlled by a control device generally designated by the reference character C (not shown) for the injection pump generally designated by the reference character P, which assures that for purposes of starting and during the partial load operation of the engine, the injection pump P correspondingly supplies with fuel only the cylinders 5 to 8 operating as the engine while during normal operation of the engine, it correspondingly supplies fuel to all cylinders 1 to 8. This control mechanism may advantageously be incorporated into the engine's governor or controller so that the position of the valves 14 and the associated manner of operation of the injection pump P will result automatically corresponding to the instantaneous engine operating requirements.

Valves 17 are arranged between the intermediate storage device 12 or 13 and the cylinders 5 to 8 operating as the engine, which permit the compressed air present in the intermediate storage devices 12 or 13 to flow into the cylinders 5 to 8 toward the end of the suction stroke and during the compression stroke of these cylinders.

In order to avoid, with increasing pressure in the cylinders 5 to 8 toward the end of their compression stroke, the forcing of air into the intermediate storage devices 12 or 13, the valves 17 are also constructed as check valves with the through-flow direction from the intermediate storage devices 12 or 13 to the cylinders 5 to 8 operating as the engine.

As shown in FIG. 3, valves 17 may be actuated from the engine cam shaft 18 by way of suitable mechanical transmission elements 19. In case the mechanical control is realizable only with difficulty or not at all due to the constructive conditions which exist in the engine 11, the valves 17 may also be actuated by electromagnetically operated mechanism generally designated by the reference numeral 20 (FIG. 3A) or by a pressure medium (FIG. 3B), which are controlled by a distributor 22 or 22' driven by the cam shaft 18 or by the engine crankshaft 21.

The application of the present invention is not limited to the type of engine construction with eight cylinders having a V-arrangement as shown in FIGS. 1 and 2 but is suited for any possible type of construction with at least two cylinders. Moreover, the number of cylinders operating as a compressor need not be equal to the number of cylinders operating as an engine. Finally, with V-engines, the cylinders operating as the compressor and as the engine may be distributed over both cylinder banks. The selection of with cylinder of an engine is to operate as the compressor and which is to operate as engine will be undertaken appropriately under consideration of the V-angle and crank-star arrangement with a view toward a uniform ignition spacing and a running of the engine in the partial load operation which is low in vibrations.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A supercharged diesel engine with a compression ratio of less than 1:12, the engine including a plurality of cylinders each having a piston reciprocally mounted therein and intake valve means and exhaust valve means for each of the cylinders, a number of the plurality of cylinders are operable for a starting operation and during a partial load operation as a compressor means for producing compressed air, the remaining cylinders of the plurality of cylinders are operable as an engine, and means for feeding the compressed air produced by the compressor means to the remaining cylinders such that the remaining cylinders are supplied with compressed air in addition to combustion air sucked in through the intake valve means of the remaining cylinders, characterized in that the feeding means includes at least one intermediate storage means for accommodating the compressed air operatively connected with the compressor means and the remaining cylinders, a first valve means are provided for controlling a flow of compressed air from the compressor means to the intermediate storage means, means are provided for controlling a positioning of the first valve means during the starting operation and partial load operation of the engine, a second valve means is provided for controlling a flow of the compressed air from the at least one intermediate storage means to the remaining cylinders, and in that means are provided for controlling a positioning of the second valve means in dependence upon a position of the piston in the remaining cylinders.

2. A diesel engine according to claim 1, characterized in that the means for controlling a positioning of the second valve means are operable to the second valve means so as to enable the compressed air to flow from the at least one intermediate storage means to the remaining cylinders during at least one of a suction stroke and a compression stroke of the remaining cylinders.

3. A diesel engine according to claim 2, characterized in that the means for controlling a positioning of the second valve means are operable to open the second valve means so as to enable the compressed air to flow from the at least one intermediate storage means to the remaining cylinders during a suction stroke and compression stroke of the remaining cylinders.

4. A diesel engine according to claim 1, characterized in that a plurality of intermediate storage means are provided, the cylinders operable as a compressor means are respectively operatively associated with a cylinder of the remaining cylinders, and in that one intermediate storage means is interposed between each compressor means and an operatively associated cylinder of the remaining cylinders.

5. A diesel engine according to claim 4, characterized in that the intermediate storage means includes a connecting line means for connecting the respective operatively associated cylinders with each other.

6. A diesel engine according to claim 5, characterized in that the first valve means includes a check valve means for enabling a flow in a direction from the compressor means toward the intermediate storage means.

7. A diesel engine according to claim 6, characterized in that the first valve means includes a further check valve means for connecting a respective compressor means with one of atmospheric air line means or suction line means of the diesel engine, and in that the further check valve means is operable to permit a flow in a direction from the line means to the compressor means.

8. A diesel engine according to claim 7, wherein the diesel engine includes a fuel injection pump means for supplying fuel to the cylinders of the engine, characterized in that means are provided for controlling the injection pump means so that, during the starting operation and partial load operation of the diesel engine, fuel is supplied only to the cylinders operating as an engine and, at higher loads of the diesel engine, fuel is supplied to all of the cylinders of the engine.

9. A diesel engine according to claim 8, characterized in that second valve means includes check valve means for enabling a flow in a direction from the intermediate storage means to an associated cylinder.

10. A diesel engine according to claim 9, characterized in that the second valve means include mechanical valves, and in that the means for controlling a positioning of the second valve means includes a cam shaft of the diesel engine.

11. A diesel engine according to claim 9, characterized in that the means for controlling a positioning of the second valve means include a pressure medium actuating mechanism.

12. A diesel engine according to claim 9, characterized in that the means for controlling a positioning of the second valve means includes an electromagnet.

13. A diesel engine according to claim 11 or 12, characterized in that the means for controlling a positioning of the second valve means further includes a control distributor means adapted to be driven by one of an engine crankshaft and an engine cam shaft.

14. A diesel engine according to claim 13, characterized in that the means for controlling a positioning of the second valve means are operable to open the second valve means so as to enable the compressed air to flow from the at least one intermediate storage means to the remaining cylinders during at least one of a suction stroke and a compression stroke of the remaining cylinders.

15. A diesel engine according to claim 1, characterized in that the first valve means includes a check valve means for enabling a flow in a direction from the compressor means toward the intermediate storage means.

16. A diesel engine according to claim 15, characterized in that the first valve means includes a further check valve means for connecting a respective compressor means with one of atmospheric air line means or suction line means of the diesel engine, and in that the further check valve means is operable to permit a flow in a direction from the line means to the compressor means.

17. A diesel engine according to claim 1, wherein the diesel engine includes a fuel injection pump means for supplying fuel to the cylinders of the engine, characterized in that means are provided for controlling the injection pump means so that, during the starting operation and partial load operation of the diesel engine, fuel is supplied only to the cylinders operating as an engine and, at higher loads of the diesel engine, fuel is supplied to all of the cylinders of the engine.

18. A diesel engine according to claim 1 or 17, characterized in that the second valve means include check valve means for enabling a flow in a direction from the intermediate storage means to an associated cylinder of the remaining cylinder.

19. A diesel engine according to claim 18, characterized in that the second valve means include mechanical valves, and in that the means for controlling a positioning of the second valve means includes a cam shaft of the diesel engine.

20. A diesel engine according to claim 18, characterized in that the means for controlling a positioning of the second valve means include a pressure medium actuating mechanism.

* * * * *